United States Patent [19]

Muehlhausen, II

[11] 4,423,916

[45] Jan. 3, 1984

[54] CABLE CONNECTOR

[75] Inventor: Almon A. Muehlhausen, II, Thousand Oaks, Calif.

[73] Assignee: Communications Technology Corporation, Los Angeles, Calif.

[21] Appl. No.: 282,656

[22] Filed: Jul. 13, 1981

[51] Int. Cl.[3] ..... H01R 4/24

[52] U.S. Cl. ..... 339/59 M; 339/99 R; 339/206 R

[58] Field of Search ..... 339/59 M, 97 R, 97 P, 339/98, 99 R, 206 R, 210 R, 210 M

[56] References Cited

U.S. PATENT DOCUMENTS

| | | | |
|---|---|---|---|
| 2,396,725 | 3/1946 | Thomas, Jr. | 339/59 M |
| 2,931,006 | 3/1960 | Klumpp, Jr. | 339/59 M |
| 3,078,438 | 2/1963 | Szental | 339/59 M |
| 3,611,264 | 10/1971 | Ellis, Jr. | 339/99 R |
| 3,772,635 | 11/1973 | Frey et al. | 339/99 R |
| 4,066,316 | 1/1978 | Rollings | 339/97 R |
| 4,174,877 | 11/1979 | Foederer | 339/97 P |
| 4,230,387 | 10/1980 | Zahn | 339/59 M |
| 4,262,985 | 4/1981 | Muehlhausen | 339/99 R |
| 4,295,704 | 10/1981 | Narozny et al. | 339/99 R |
| 4,343,528 | 8/1982 | Lucius et al. | 339/206 R |

FOREIGN PATENT DOCUMENTS

| | | | |
|---|---|---|---|
| 2540550 | 4/1977 | Fed. Rep. of Germany | 339/99 R |
| 2653593 | 6/1977 | Fed. Rep. of Germany | 339/99 R |

*Primary Examiner*—John McQuade
*Assistant Examiner*—Gary F. Paumen
*Attorney, Agent, or Firm*—Harris, Kern, Wallen & Tinsley

[57] ABSTRACT

A multipiece connector for making electrical connections between electrical cables, each having a plurality of insulated wires. The connector includes an index strip, a connector module strip and a module cap strip, with the index strip having slots for laying in wires of one cable, with the connector module strip having slots for laying in wires of the other cable and double ended slotted contact elements, and with the module cap strip having a plurality of wire confining means aligned with the slots. The connector module strip snap mounts to the index strip and the slotted contact elements penetrate the wire insulation making electrical contact with the wires of the cable, and the module cap strip snap mounts to the connector module strip and the other ends of the slotted contact elements penetrate the wire insulation making electrical contact with the wires of the cable. The connector module strip has top and bottom members joined together with contact elements therebetween, the top member including a plurality of pins for entering corresponding openings in the bottom member, with contact elements positioned between pins. Each of the strips includes reduced structural sections at predetermined locations for separating the strips into a plurality of shorter pieces, with the connector module strip pins at the predetermined locations divided into two portions with a slot therebetween, and with the bottom member at the predetermined locations having spaced walls with a slot therebetween, with spaced walls entering pin slots.

8 Claims, 11 Drawing Figures

CABLE CONNECTOR

BACKGROUND OF THE INVENTION

This invention relates to electrical connectors and in particular, to a new and improved connector design for use in connecting conductors of one cable to conductors of a second cable.

More particularly, the present invention relates to an improvement in the electrical connector of the type commonly known in the telephone industry as a 710 connector which has substantially the structure disclosed in the Frey et al U.S. Pat. No. 3,772,635. Basically, such a connector is an elongate strip which accommodates a plurality of conductors in a row, typically fifty or twenty-five pairs, for making electrical connections between a first group of such conductors and a second group of such conductors. Certain forms of the connector also provide for making connections with a third group of such conductors. The connector includes an index strip, a connector module strip and a module cap strip, and may also include a bridge module strip and another module cap strip.

The components of the connector snap together with the wires appropriately positioned therein, as described in detail in the aforementioned Frey patent and reference may be made to said patent for details of construction and use of the basic connectors. One improved version is shown and described in the copending application U.S. Ser. No. 201,146, filed Oct. 27, 1980 now abandoned, and assigned to the same assignee as the present application.

The standard 710 connector utilized in the telephone industry for interconnecting twenty-five pairs of conductors is 7" long. The connectors are utilized for making cable connections in the field, often under adverse working conditions, and in many instances fewer than twenty-five pairs are to be joined. It is an object of the present invention to provide a new and improved connector suitable for handling twenty-five pairs of conductors, while at the same time being constructed so that the worker in the field can shorten or divide the standard twenty-five pair connector at predetermined locations to produce a shorter connector, typically a connector which will handle five pairs, ten pairs, fifteen pairs or twenty pairs. A particular object is to provide such a connector wherein each of the components includes reduced structural sections at the predetermined locations providing means for separating the components into a plurality of shorter components.

The conductors of the cables are inserted in the connector components and the connector components are joined together by means of a tool identified as a cutter/presser. End slots are provided in the standard connector for accurately locating and supporting the connector in the standard cutter/presser. It is an object of the present invention to provide a new and improved connector incorporating bottom support and locating openings to provide improved connector support in the assembly tool. The standard connector typically incorporates rear latching for holding the connector in the tool during assembly, with a resultant tendency for the connector to rotate. It is another object of the invention to provide a new and improved connector incorporating front latching slots for engagement with the assembly tool to maintain the connector in the proper position. It is a particular object of the invention to provide such improved construction for the incremental five pair sections into which the twenty-five pair connector may be divided, as the smaller sections cannot be handled in the standard cutter/presser and may be assembled with smaller tools.

Difficulty has been encountered in the past in accessing the conductors of an assembled 710 connector for test purposes. It is an object of the present invention to provide a new and improved connector incorporating means providing for easy access to the contact elements within the connector and in particular providing test pin access to the flat surface of a contact element.

From time to time, the cap strip of a connector needs to be removed and it is another object of the present invention to provide a new and improved cap strip configuration incorporating through holes for tool insertion for popping a cap off the connector or bridge module strip.

Other objects, advantages, features and results will more fully appear in the course of the following description.

SUMMARY OF THE INVENTION

The present invention is an improvement in the conventional elongate strip connector used in the telephone industry for interconnecting wires of cables, with the improved connector providing for separation into shorter pieces, typically for handling wires in groups of five pairs. This is accomplished with reduced structural sections at predetermined locations, and with split pins and slotted walls at the predetermined locations.

A connector includes a connector module strip or a bridge module strip, and a module cap strip, with the cap strip snap mounting to the connector module strip or bridge module strip with a plurality of wire conductors attached thereto. A connector may also include an index strip snap mounted to the connector module strip with a second group of conductor wires attached thereto.

The improved connector of the invention also includes access holes in the connector module strip or bridge module strip leading to the respective contact elements in the module strip, support and locating holes in the bottom of the index strip and latching slots in a side of the index strip, and removal holes in the cap strip.

DESCRIPTION OF THE PREFERRED EMBODIMENT

Figure 1:
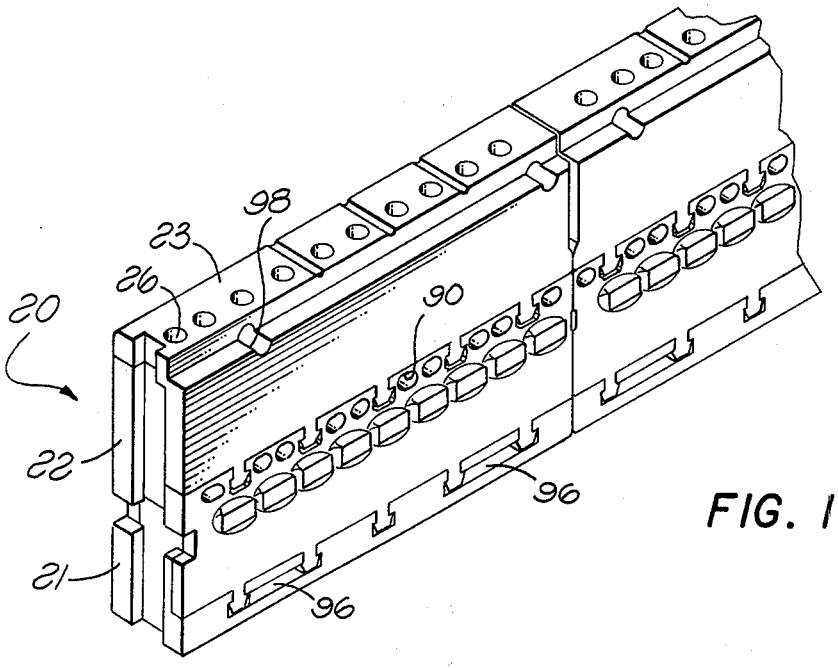
FIG. 1 is a fragmentary perspective view of a so-called 710 connector substantially as disclosed in the aforementioned Frey et al patent, and including an index strip, a connector module strip and a module cap strip and incorporating the presently preferred embodiment of the invention.
Figure 2:
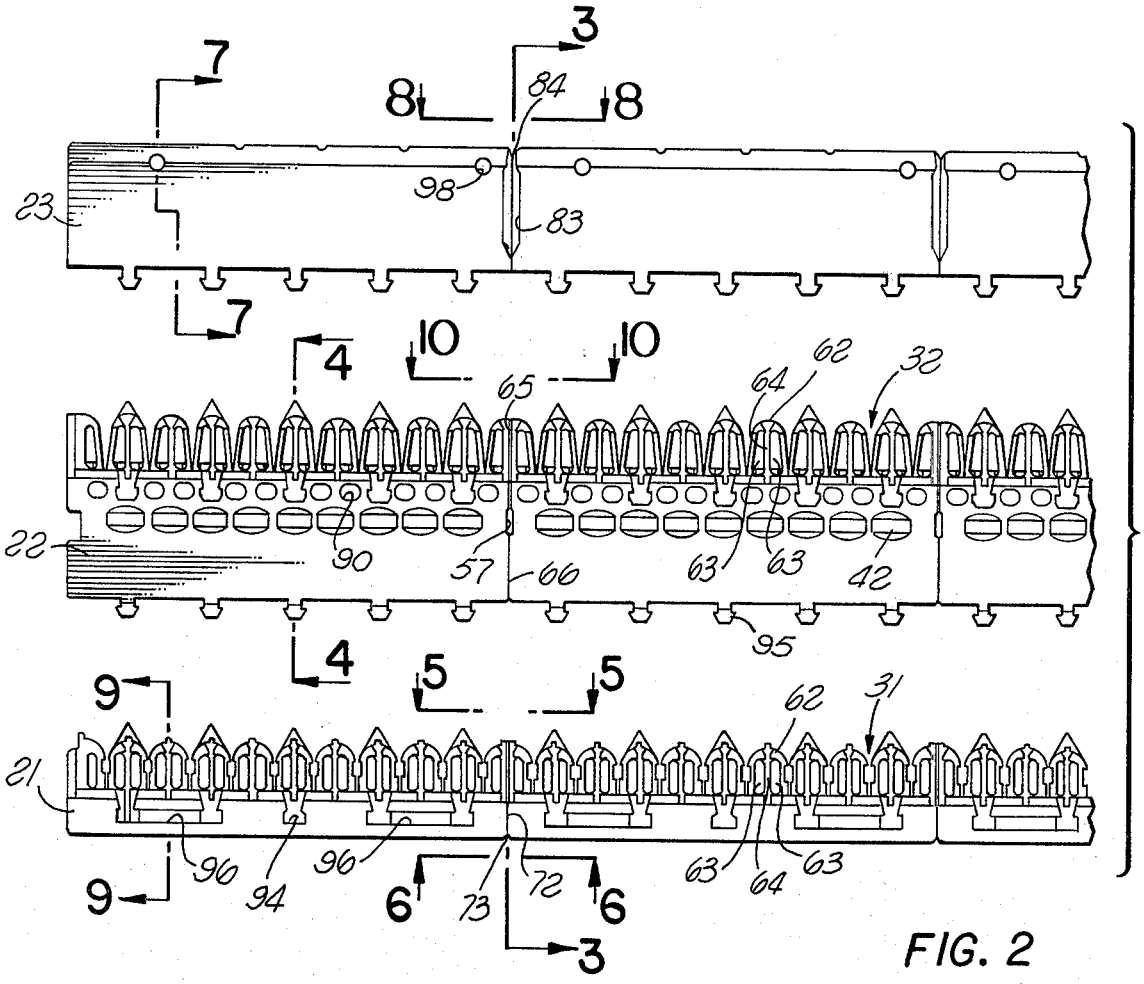
FIG. 2 is an exploded elevational view showing the components of the connector illustrated in FIG. 1.
Figure 11:
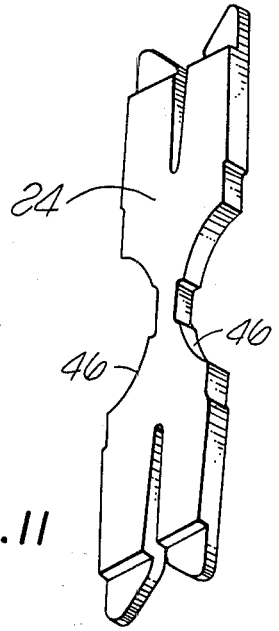
FIG. 11 is an enlarged perspective view of a contact element of the connector of FIGS. 1 and 2.

Referring initially to FIGS. 1 and 2 of the drawings in particular, illustrated fragmentarily therein is a connector 20 having substantially the structure fully disclosed in the aforementioned Frey et al patent, thereby making it unncessary to describe the connector 20 in detail herein. Briefly, the connector 20 includes an index strip 21, a connector module strip 22 and a module cap strip 23. The connector module strip 22 carries plural double-ended slotted contact elements 24 (FIG. 11) capable of receiving insulated wire conductors of a cable with the conductors extending into the index strip 21, and insulated wire conductors of another cable with the conductors extending into the connector module strip 22. The index strip 21 may be provided with access holes 25 (FIG. 6) for access to the conductors of the one cable, and the module cap strip 23 may be provided with access holes 26 (FIG. 1) for access to the conductors of the other cables. Preferably, electrical contact through the access holes 25 or 26 is made to the conductors by engaging the contact elements 24, and through the contact elements to a conductor positioned therein.

The connector may also include a bridge module strip (not shown) having another module cap strip (which may be identical to the cap strip 23) and adapted to accommodate a plurality of conductors in the same manner as the connector module strip. As fully disclosed in the aforementioned Frey et al patent, the bridge module strip conductors engage contact elements in the bridge module similar to the contact elements 24 hereinbefore mentioned, and, as also shown in the Frey et al patent, the bridge module strip and module cap strip may be assembled with the index strip, the connector module strip and the module cap strip of the connector to establish electrical interconnection between the bridge module strip conductors and the conductors of the previously mentioned cables. Consequently, a detailed description herein is not necessary.

Figure 5:
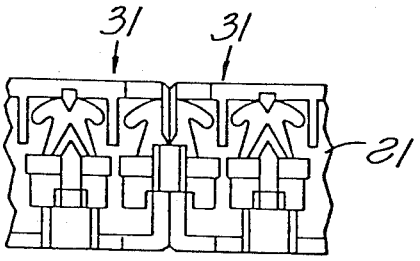
FIG. 5 is an enlarged partial top view of the index strip of FIG. 2 taken along the line 5—5.
Figure 7:
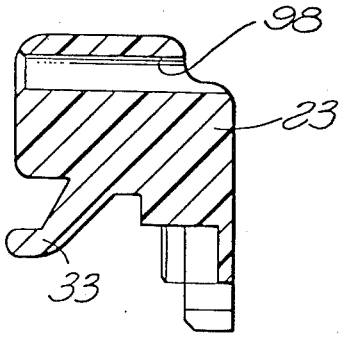
FIG. 7 is an enlarged sectional view taken along the line 7—7 of FIG. 2.

The index strip 21 has a plurality of wire receiving slots 31 (FIGS. 2 and 5) in a row for laying in the cable conductors, the connector module strip 22 has a plurality of similar wire receiving slots 32 (FIGS. 2 and 10) in a row for laying in the other cable conductors, and the module cap strip 23 has a plurality of wire confining ribs 33 (FIG. 7) aligned with the slots 32. The wires are pressed into the contact elements by a conventional tool, with the contact elements penetrating the wire insulation making electrical contact with the wires. The connector module strip snap mounts to the index strip. Similarly, the wires are pressed into the other ends of the contact elements, which penetrate the wire insulation making electrical contact with the wires. The module cap strip snap mounts to the connector module strip.

The connector as described above is conventional and is shown in the aforementioned patent and application. New features of the connector are described hereinbelow.

Each of the strips includes reduced structural sections at predetermined locations to provide means for separating the strips into a plurality of shorter pieces. In the embodiment illustrated, the conventional twenty-five pair strips are designed for separation at five pair intervals, permitting the workman to reduce the connector components in the field to a five pair connector, a ten pair connector, a fifteen pair connector, or a twenty pair connector.

Figure 3:
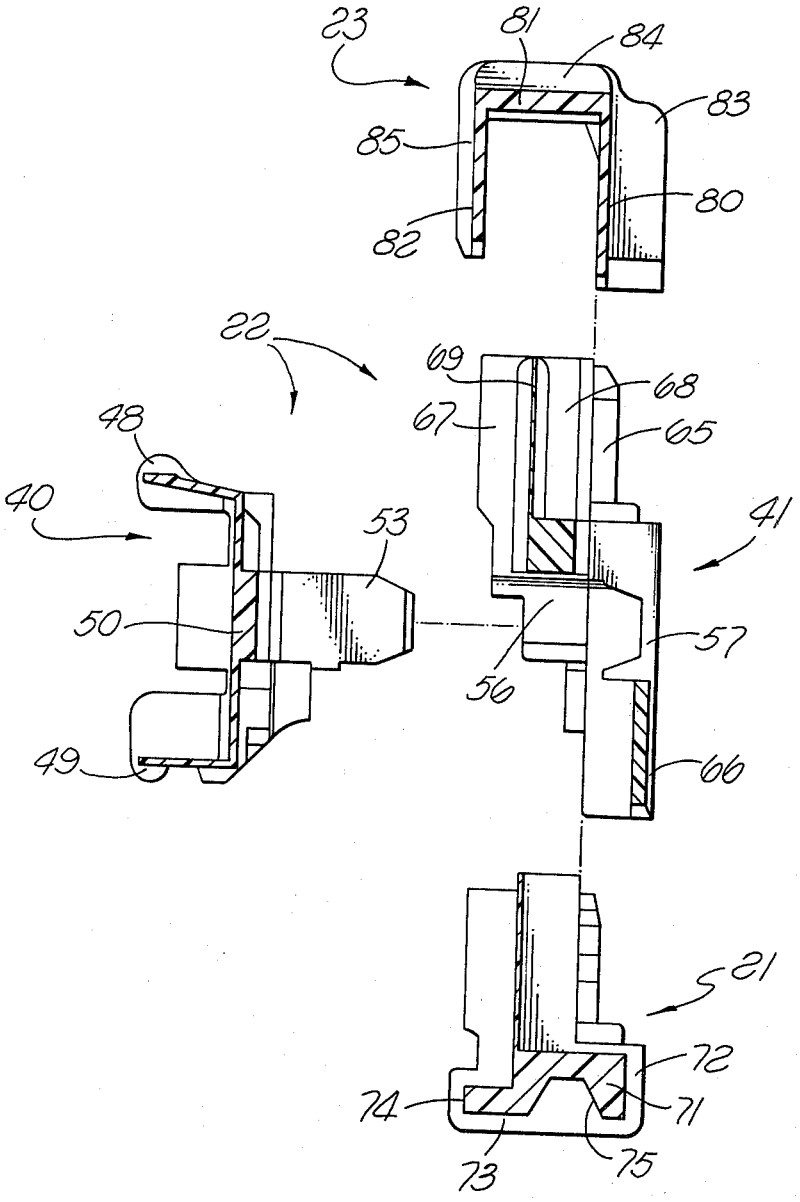
FIG. 3 is an enlarged sectional view taken along the line 3—3 of FIG. 2.
Figure 4:
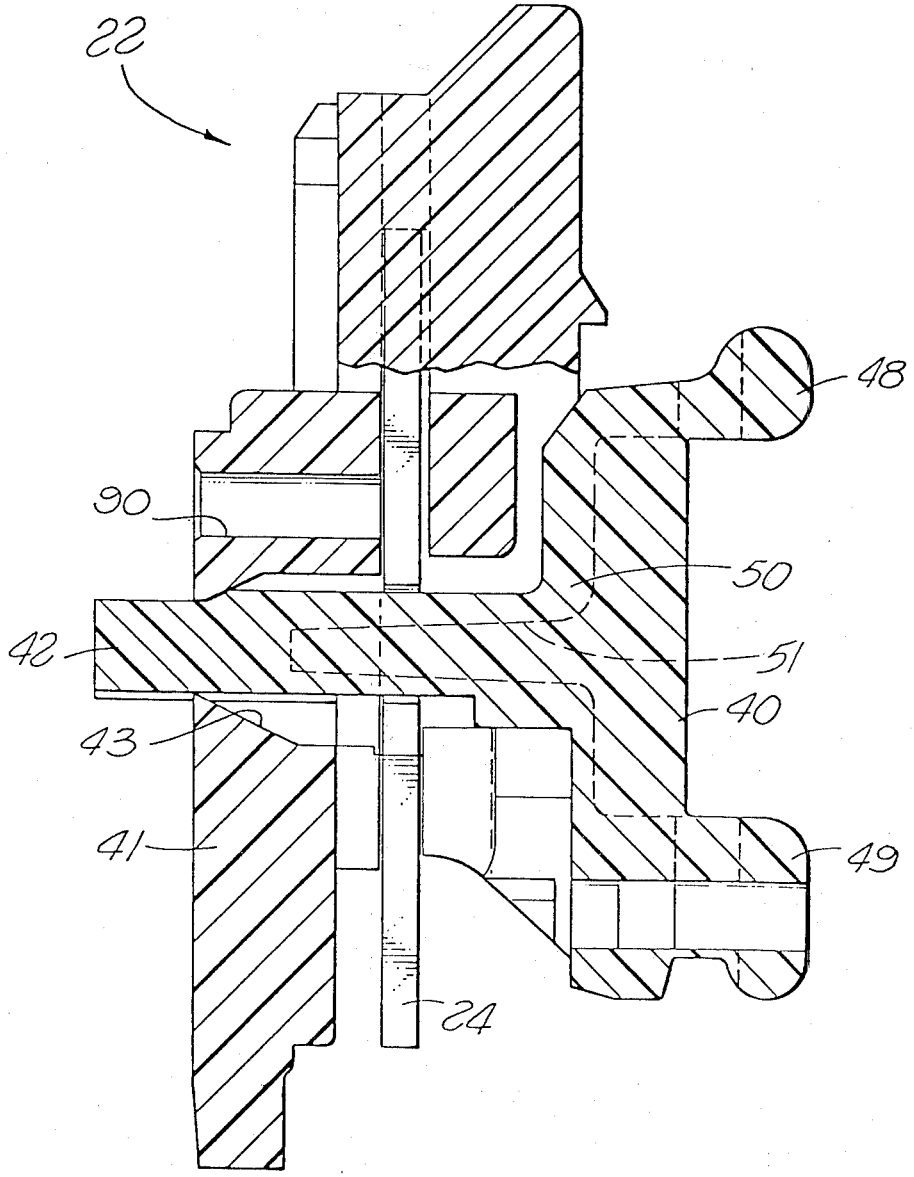
FIG. 4 is an enlarged sectional view taken along the line 4—4 of FIG. 2.
Figure 10:
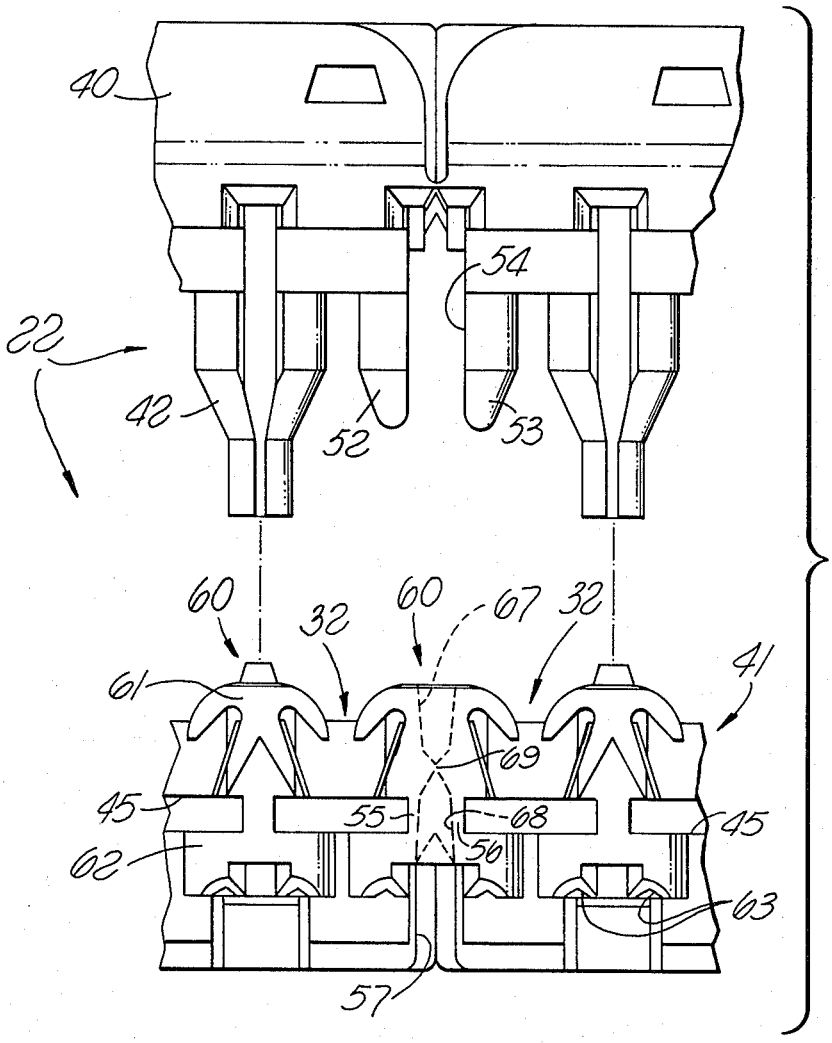
FIG. 10 is an enlarged partial top view of the connector module strip of FIG. 2 taken along the line 10—10.

The connector module strip 22, best seen in FIGS. 3, 4 and 10, comprises a top member 40 and a bottom member 41, with a plurality of the contact elements 24 positioned therebetween. Pins 42 carried on the top member 40 project through openings 43 in the bottom member 41. The ends of the pins 42 are flattened or enlarged, typically by heat and pressure, to join the top and bottom members together. The contact elements 24 are positioned in spaces 45 in the bottom member 41, with the pins 42 located in notches 46 of the contact elements 24 for positioning the contact elements.

The top member 40 has an upper wing 48 and a lower wing 49 joined by a central portion 50, best seen in FIG. 4, with the wings and central portion extending continuously for the length of the connector. Holes 51 in the central portion 50 provide openings for the contact elements 24 of a bridge module strip to engage corresponding contact elements 24 of the connector module strip 22, with the bridge module strip positioned between the wings 48, 49, in the conventional manner. The wings and central portion are provided with reduced structural sections at predetermined locations by reducing the cross section area of the wings and central portion at such locations. The section 3—3 of FIG. 2 is taken at one such predetermined location, and the reduced structural sections for the top member 40 are shown in FIG. 3.

The pins of the top member at the predetermined locations has a different shape than the other pins 42. These pins are divided into two portions 52, 53 with a slot 54 therebetween, as best seen in FIG. 10.

In the bottom member 41, the opening for receiving the divided pin portions 52, 53 is different from the openings 43 for the standard pins 42. The central portion of the opening has walls 55, 56 with a slot 57 therebetween, with the walls 55, 56 positioned within the slot 54 of the divided pin portions 52, 53, when the top and bottom members are joined together. When the connector module strip is broken apart at the predetermined location, the wall 55 and pin portion 52 provides a complete end for one connector section and the wall 56 and pin portion 53 provides a complete end for the other connector section.

In the bottom member 41, the wire receiving slots 32 are defined by teeth 60, with each tooth having a rear wing section 61 and a front window section 62. Each front window section 62 has two windows 63 therethrough separated by a mullion 64. As best seen in FIG. 2, the mullions at the predetermined locations are wider than the standard mullions and have a groove 65 therein. The lower portion of the bottom member 41 has a similar groove 66, and notches 67, 68 in the rear wing section 61 are separated by a web 69 at the predetermined locations. This construction provides for ease of separation of the connector module strip at each of the predetermined locations.

Figure 6:
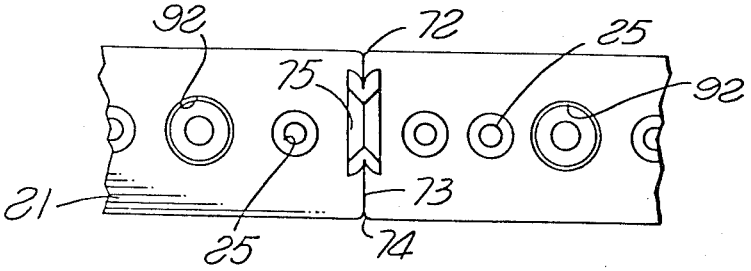
FIG. 6 is an enlarged partial bottom view of the index strip of FIG. 2 taken along the line 6—6.

The index strip 21 has a similar construction with teeth having a rear wing section and a front window section with two windows therethrough, with the rear wing section having front and rear notches separated by a web at each of the predetermined locations, and with the front window section having a wider grooved mullion at each of the predetermined locations. Also, the index strip has a continuous base 71 with front, bottom and back grooves 72, 73, 74, respectively at the predetermined locations, as well as a bottom notch 75 for separating the index strip at the predetermined locations (FIGS. 3 and 6).

Figure 8:
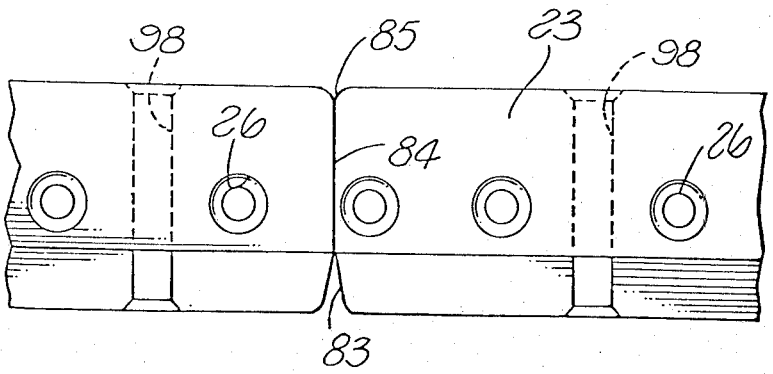
FIG. 8 is an enlarged partial top view of the cap strip of FIG. 2 taken along the line 8—8.

The module cap strip 23 has continous front, top and rear sections, 80, 81, 82, respectively, each extending the length of the module cap strip, with groove 83, 84, 85, respectively, at the predetermined locations, for separating the module cap strips (FIGS. 3 and 8).

The bottom member 41 of the connector module strip 22 has access holes 90 therethrough, with at least one access hole for each contact element (FIGS. 1, 2 and 4). These access holes provide for electrical access to each of the contact elements for test purposes after the connector has been assembled. Access may be made by various probe devices, typically a cap shoe with spring loaded contact pins. This form of access makes engagement with the flat surface of the contact elements, providing improved electrical continuity and reducing the likelihood of damage to the components. Since the access is through the bottom member, the access may be utilized when a bridge module strip is attached to the connector module strip.

Locating openings 92 are provided in the bottom of the index strip 21 (FIGS. 6 and 9) with at least two such openings between each predetermined location, that is with predetermined locations providing for dividing a standard twenty-five pair connector into five 5 pair sections, ten of the openings 92 would be utilized. These bottom locating openings provide for accurately locating and supporting the connector during wire insertion and assembly. Mating bosses would be provided in the cutter/presser tool for engaging these openings.

Figure 9:
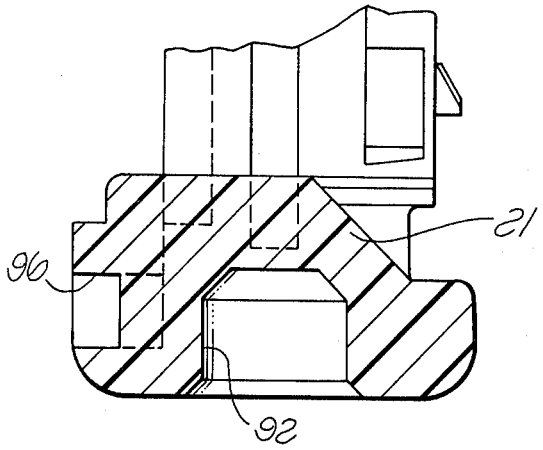
FIG. 9 is an enlarged partial sectional view taken along the line 9—9 of FIG. 2.

In the standard connector, notches 94 are provided in the front of the index strip 21 for receiving mating tongues 95 of the connector module strip 22 for holding the components together, and similar configurations are provided for the connector module strip 22 and module cap strip 23 (FIGS. 1 and 2). In the present embodiment, latching slots 96 are provided in the front of the index strip 21, preferably with a latching slot on each side of each predetermined location and at each end of the connector (FIGS. 1, 2 and 9). The cutter/presser tool may be provided with fingers for insertion in the slots 96 to provide improved holding ability for the index strip in the tool and to counter the rotational tendency of the conventional rear latching tools.

Holes 98 are provided through the module cap strip from the front to rear of the strip, preferably with at least two of the holes in each five pair section of the strip (FIGS. 1, 2, 7 and 8). From time to time it is desirable to remove the module cap strip from an assembled connector. By providing these through holes 98 on each side of each of the predetermined locations and at the ends of the strip, a tool may be readily inserted in the holes and used to remove the module cap strip from the connector module strip or bridge module strip.

In use, the workman determines the desired length of the connector and then separates the index strip, the connector module strip, and the module cap strip at the predetermined location which will provide the desired number of conductor pairs. The strips may be separated by bending and the separation may be assisted by utilizing a knife edge to cut the thin webs. With the construction of the present invention, the components of the connector may be separated as desired while maintaining component integrity and function, including support, wire gripping and aligning, electrical continuity, and insulation.

I claim:

1. In a multipiece connector for making electrical connections between first and second electrical cables, each cable having a plurality of insulated wires therein, the connector including an index strip, a connector module strip and a module cap strip, with the index strip having a plurality of first wire receiving slots in a row for laying in wires of the first cable, with the connector module strip having a plurality of second wire receiving slots in a row for laying in wires of the second cable and double ended slotted contact elements, and with the module cap strip having a plurality of wire confining means aligned with the second slots, with the connector module strip snap mounting to the index strip and the slotted contact elements penetrating the wire insulation making electrical contact with the wires of the first cable, and with the module cap strip snap mounting to the connector module strip and the other ends of the slotted contact elements penetrating the wire insulation making electrical contact with the wires of the second cable, and with said connector module strip having a top member and a bottom member joined together with said contact elements therebetween, said top member including a plurality of pins for entering corresponding openings in said bottom member, with said contact elements having notches for positioning between said pins, the improvement wherein each of said strips includes reduced structural sections at predetermined locations defining means for separating the strips into a plurality of shorter pieces, with said connector module strip pins at said predetermined locations divided into two portions with a slot therebetween, and with said bottom member at said predetermined locations having spaced walls with a slot therebetween, with said spaced walls entering said pin slots.

2. A connector as defined in claim 1 wherein said top member has a continuous upper wing, a continuous central portion, and a continuous lower wing, each extending the length of said connector module strip, and with said upper and lower wings continuously joined to said central portion,with said upper and lower wings reduced in cross section area at each of said predetermined locations, and said bottom member has teeth defining said second wire receiving slots, each of said teeth having a rear wing section and a front window section with two windows therethrough, with said rear wing section having front and rear notches separated by a web at each of said predetermined locations, and with said front window section having a wider grooved mullion at each of said predetermined locations.

3. A connector as defined in claim 2 wherein said index strip has a continuous base reduced in cross section area at each of said predetermined locations, and has teeth defining said first wire receiving slots, each of said teeth having a rear wing section and a front window section with two windows therethrough, with said rear wing section having front and rear notches separated by a web at each of said predetermined locations, and with said front window section having a wider grooved mullion at each of said predetermined locations.

4. A connector as defined in claim 3 wherein said module cap strip has continuous front, top and rear sections, each extending the length of said module cap strip and continously joined together, with said sections reduced in cross section area at each of said predetermined locations.

5. A connector as defined in claim 1 including means defining access holes in said connector module strip bottom member perpendicular to the plane of said contact elements,with an access hole aligned with each of said contact elements providing electrical access through said connector module strip to the contact element.

6. A connector as defined in claim 5 wherein said index strip has a base with bottom, front and back, with locating openings formed in said bottom, with at least two of such openings between adjacent predetermined locations.

7. A connector as defined in claim 6 wherein said index strip front includes first means defining spaced notches for said snap mounting of said connector module strip, and second means defining latching slots between said notches, with a latching slot on each side of each of said predetermined locations.

8. A connector as defined in claim 7 wherein said module cap strip includes means defining through holes from front to rear, with one of said holes on each side of each of said predetermined locations.

* * * * *